US006089769A

United States Patent [19]

Farb

[11] Patent Number: 6,089,769

[45] Date of Patent: Jul. 18, 2000

[54] LINE PRINTER HAMMERBANK COVER WITH SPACED APART THICKENED SECTIONS

[75] Inventor: Norman E. Farb, Villa Park, Calif.

[73] Assignee: Printronix, Inc., Irvine, Calif.

[21] Appl. No.: 09/245,474

[22] Filed: Feb. 5, 1999

Related U.S. Application Data

[60] Provisional application No. 60/102,259, Sep. 29, 1998.

[51] Int. Cl.[7] ..... B41J 35/06; B41J 29/12; B41J 29/13

[52] U.S. Cl. ..... 400/248; 400/247; 400/693

[58] Field of Search ..... 101/93.08, 93.37, 101/93.43, 93.48, 94, 93.04, 93.05, 93.29, 93.28; 400/247, 248, 157.2, 124.08, 124.17, 124.18, 124.19, 124.2, 693

[56] References Cited

U.S. PATENT DOCUMENTS

| | | | |
|---|---|---|---|
| 3,556,002 | 1/1971 | Bragg | 101/93.48 |
| 4,553,864 | 11/1985 | Hayashi | 101/93.04 |
| 4,616,943 | 10/1986 | Matsumoto et al. | 400/247 |
| 4,879,947 | 11/1989 | Kurosawa et al. | 101/93.29 |
| 5,743,665 | 4/1998 | Ryan et al. . | |
| 6,000,330 | 12/1999 | Farb et al. | 101/93.04 |

FOREIGN PATENT DOCUMENTS

| | | |
|---|---|---|
| 58-057936 | 10/1984 | Japan . |
| 5-38821 | 2/1993 | Japan . |
| 89/11973 | 12/1989 | WIPO . |

*Primary Examiner*—John S. Hilten
*Assistant Examiner*—Daniel J. Colilla
*Attorney, Agent, or Firm*—George F. Bethel

[57] ABSTRACT

A line printer having a hammerbank for printing on media with print hammers to impact a ribbon to form a dot matrix array having printing tips and permanent magnets for magnetically retaining the hammers. Coils release the hammers by overcoming the magnetism to impact a platen against which the hammer printing tips can strike a ribbon and the underlying media. A cover overlies the hammers having an elongated ridge, and is secured to the hammerbank by threaded members. A print ribbon mask is threadably secured to the cover with openings indexed to openings of the cover to allow the passage of the printing tips.

14 Claims, 5 Drawing Sheets

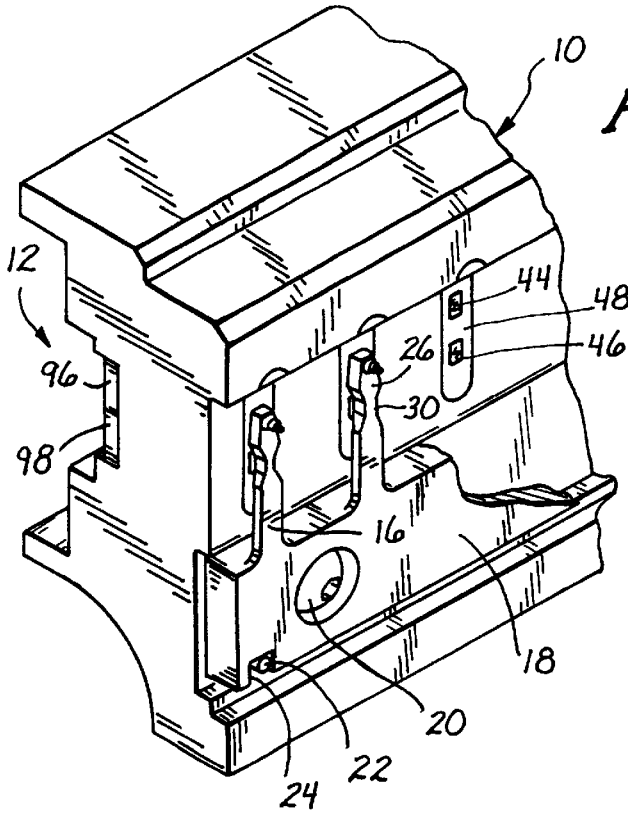
Fig. 5
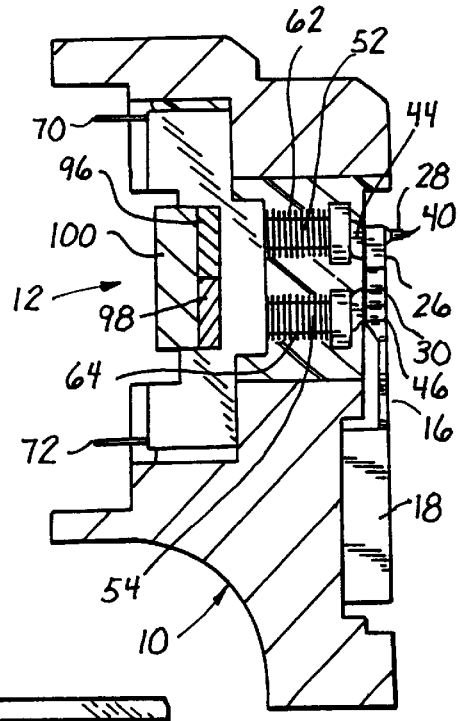
Fig. 6
Fig. 4
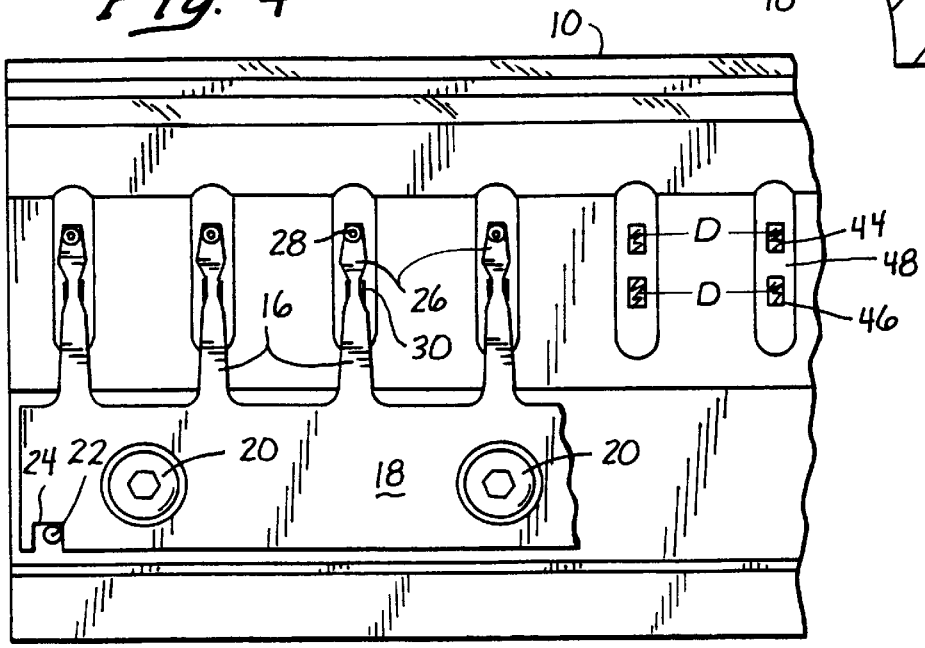

LINE PRINTER HAMMERBANK COVER WITH SPACED APART THICKENED SECTIONS

This application claims the benefit of U.S. Provisional Application Ser. No. 60/102,259, filed Sep. 29, 1998, entitled a Line Printer Hammerbank Cover, Inventor Norman E. Farb.

Your Petitioner Norman E. Farb a citizen of the United States of America and a resident of Orange County in the State of California whose residence and post office address is 10705 Providence Drive, Villa Park, California 92667 prays that letters patent may be granted to him for the invention of a LINE PRINTER HAMMERBANK COVER as set forth in the following Specification.

BACKGROUND OF THE INVENTION

1. Field of the Invention

The field of this invention lies within the dot matrix printing art. More particularly, it lies within the field of dot matrix printing that is accomplished by what is known as a line printer. Such line printers are known to have a hammerbank with a multiplicity of hammers thereon which are released from permanent magnetic retention by an electrical coil to allow release thereof. In particular, this invention relates to the hammerbank itself and the respective cover for the print hammers.

2. Prior Art

The prior art with regard to line printers has evolved over the years. Such line printers are known to have a plurality of hammers on a hammerbank. These hammers are provided with tips which strike a ribbon in order to impact a print media thereunder. Upon striking the print media with the tips against the print ribbon, an impacted dot is printed to provide dot matrix printing.

It is known that these hammers can be retained by a permanent magnet in a sprung position. When the permanent magnetism is released by coils overcoming the permanent magnetism, the hammers are then released in order to impact the print ribbon against the print media to create the dot matrix printing known in the art.

The operation of such hammerbanks is generally fraught with multiple dynamic loadings. These multiple dynamic loadings are the product of numerous reciprocations of the hammerbank, release of the hammers and vibrations.

The foregoing, creates dynamic force moments and torque on the hammerbank which can oftentimes distort the placement of the dots of the dot matrix printer against the media that is to be printed upon. In such cases, the net result is that a significant problem is associated with such printing due to the inconsistencies and displacement of the printed dots with respect to each other.

It has been felt that if the dynamic motion which distorts a hammerbank, even if it is distorted ever so slightly, can be diminished or somewhat eliminated, that improved printing can be accomplished. In order to do this, the respective hammerbank and cover relationships should be moderated to improve the stiffness so as to reduce the dynamic distortion of the hammerbank and cover assembly during the reciprocation and firing of the hammers.

The prior art hammerbanks generally incorporated a simple flat cover stamped from magnetic stainless steel which magnetically interacted with the hammerbank and the hammersprings. This flat cover was located with respect to the hammerbank and the hammerspring tips by incorporation of two punched holes. One of the holes was round and the other oblong, which were placed over two steel locating pins on the hammerbank. The acceleration forces of the hammerbank would eventually wear the round alignment holes larger. These alignment holes were placed so that the tips were initially in the center of the protrusion holes. In order to improve this, positive clamping of the cover to the hammerbank by screws helped to prevent the cover moving with respect to the tips.

The hammerbank covers of the prior art were retained by multiple slots containing attracting magnetic components along the elongated portions thereof. This relationship created a deflectable and yielding hammerbank cover during printing because of dynamic and static forces. One of the end results was that this yielding increased tip protrusion of the hammerbank tips which can cause ribbon snagging. In order to improve this, positive support of the cover of this invention next to the tip locations via a pedestal touching the hammerbank creates very high stiffness eliminating or greatly reducing deflection of the hammerbank.

Additionally thereto, the print mask had to be bonded or welded to the magnetic stainless steel cover thereby creating a problem associated with replacement parts, wear, repair, and overall manufacturing procedures. In order to improve this, easy replacement is created by bolting the mask to the cover.

The new cover of this invention creates a hammerbank cover which is non-magnetic and is machined from an aluminum extrusion. The hammerbank cover is bolted to the frame with the mask bolted to the cover. This increases the overall stiffness of the hammerbank, cover, and mask combination. The net result is to provide for improved flatness, and reduction of dynamic deflections that change the relationship of the hammerbank with regard to its normal position and geometry.

The invention provides an improved hammerbank cover that is subject to less deformation, deflection, and provides for a lesser incidence of wear and increased serviceability.

The foregoing stiffness helps to diminish vibration and results in improved printing characteristics.

The cover has a pedestal machined next to the ends of the hammersprings. The pedestal rests upon the hammerbank precision machined surfaces. This provides a more accurate tip protrusion manufacturing technique without adjustment.

The alignment of the holes of the cover with respect to the hammerbank and hammerspring location is fixed and does not change significantly. To the contrary, the former stainless steel covers shifted and the alignment holes were somewhat shifted during turnaround of the hammerbank or the attendant reciprocation.

The increased stiffness of the hammerbank and cover combination provides for improved flatness and less deflection and is enhanced by the pedestal geometry. Further to this extent, during repairs, replacement, or changes, the mask can be bolted to the cover and easily changed for improved replacement, and associated and related operational procedures.

SUMMARY OF THE INVENTION

In summation, this invention provides for a nonmagnetic machined extrusion forming a hammerbank cover that is bolted to the hammerbank to increase stiffness while at the same time reducing deflection and deformation of the hammerbank and the cover and the mask for improved indexing and relationship of the hammers during the printing process resulting in more accurate printing.

More specifically, the invention provides for a non-magnetic magnetic cover that has been machined from stock such as an elongated piece of aluminum. It is machined from aluminum that can be an extrusion and then bolted to the hammerbank. The net result is that the bolting to the hammerbank provides for a greater degree of stiffness by providing for greater beam strength along the length of the hammerbank as well as transversely across the hammerbank resulting in decreased dynamic movements as well as overall deflection.

BRIEF DESCRIPTION OF THE DRAWINGS

FIG. 4 shows a fragmented front elevation view of a hammerbank without the cover.

FIG. 5 shows a fragmented perspective view of the hammerbank without the cover.

FIG. 6 shows a sectional view of the hammerbank without the cover detailing the hammer, coils, and permanent magnets.

DESCRIPTION OF THE PREFERRED EMBODIMENTS

Figure 1:
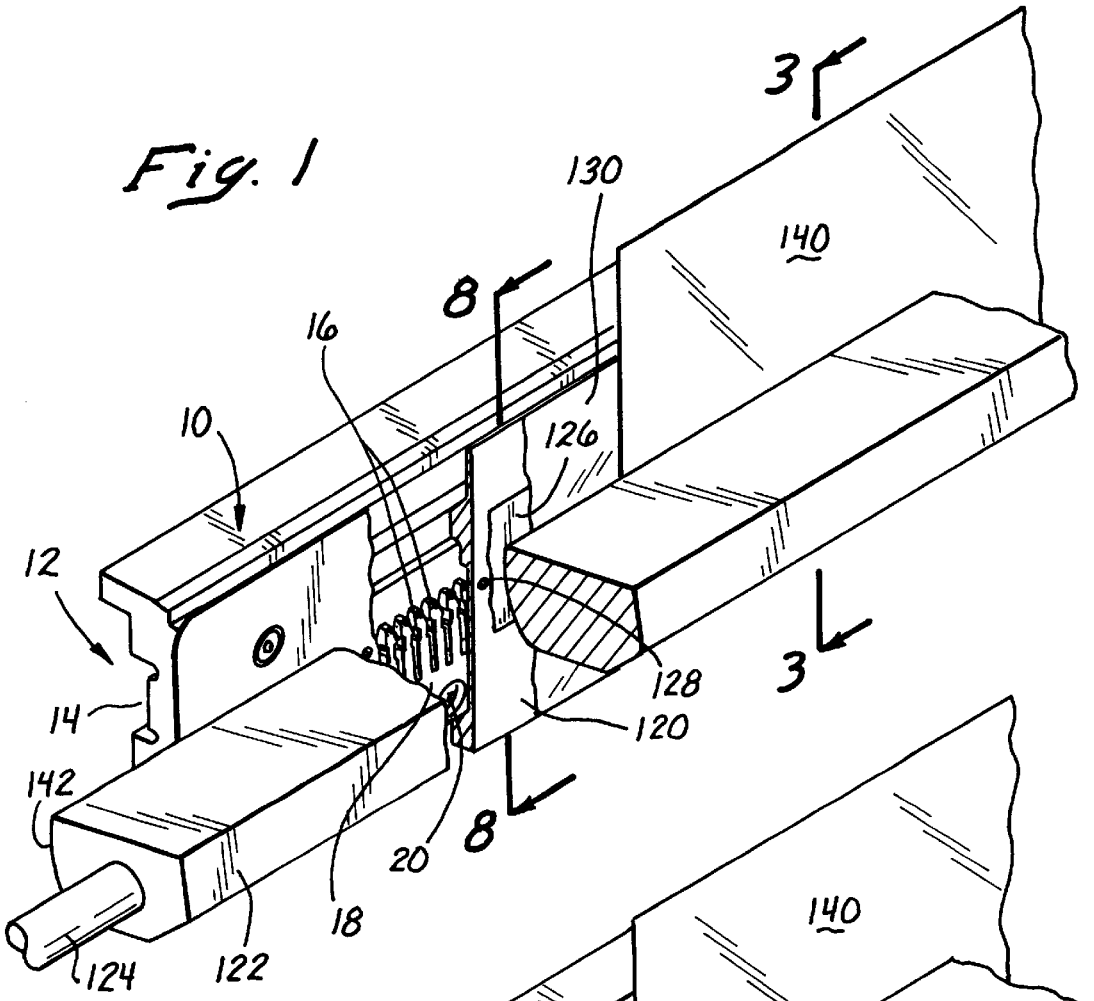
FIG. 1 shows a fragmented perspective view of this invention illustrating the cover and other portions of the hammerbank as well as the platen.

Looking specifically at FIG. 1, it can be seen that a hammerbank portion in the form of a fragmented segment toward the end of the hammerbank is shown. The fragmented portion of the hammerbank is a segment that is cut from an elongated hammerbank having approximately anywhere from forty to one hundred print hammers more or less that can be retained and then fired or released against a print ribbon as is well known in the art.

The hammerbank 10 is such wherein the base or shuttle is generally machined or cut from an elongated metal portion such as an aluminum casting or extrusion. It can be formed in any other suitable manner to provide for an elongated mounting of the hammers on the hammerbank. In this particular case, it can be seen that the hammerbank has an area 12 which can receive an elongated circuit board or other controlling means such as in U.S. Pat. No. 5,743,665 dated Apr. 8, 1998. Also, the hammerbank has an elongated channel or groove 14 which receives split permanent magnets as will be described hereinafter.

As is customary in printer hammerbanks, they can comprise a series of hammers 16 connected to and formed on a fret 18. The fret 18 is secured to the hammerbank by screws, nuts or bolts or any other securement means shown generally as screws 20. For proper indexing, an indexing pin 22 is provided in order to allow a slotted portion 24 of the fret 18 to be indexed thereagainst for securement.

The hammers 16 comprise an enlarged portion 26 to which a pin 28 is welded, brazed or otherwise connected thereto. The enlarged portion 26 terminates in a necked down spring portion 30 connected to and formed with the fret 18. This entire structure and shape of the hammers 16 can be configured in other suitable manners to allow for the dynamics of printing as is understood in the art.

Each pin 28 has a reduced tip 40. The reduced tip 40 is the portion that is impacted against a ribbon in order to form a dot matrix printing array, pattern, alpha numeric symbols, Oriental style lettering, a particular pattern, or pictorial representation.

In order to retain the hammers which are sprung for printing movement away from the hammerbank, a permanent magnetic force is applied through a pair of pole pins, pole pieces, or pole members which provide the magnetic circuit. These terminate in upper and lower pole piece termination sections, hammer contacts, terminals or pins, 44 and 46. These pole piece terminal portions 44 and 46 are generally provided with a surface 48 therebetween against which a hammer 16 can be retracted and creates an impact or wear surface.

Looking more particularly at FIG. 6 the terminal points or magnetic contact portions of the pole pieces 44 and 46 are shown with pole pieces 52 and 54. The pole pieces 52 and 54 are wound with wire coils 62 and 64. Oftentimes, the mutual inductance created by permeance between adjacent pole pieces and adjacent hammers can be such where it cascades through the respective adjacent interfacing pole pieces and interfacing hammers thereby causing imbalanced performance. To reduce this, the overall interfacing area of adjacent pole pieces is diminished.

The permeance is inversely proportional to the distance D between the pole pieces and directly proportional to the facing areas of neighboring pole pieces. By proportionally diminishing interfacing adjacent side by side surface areas there is less permeance and less correlative mutual and self inductance.

As in the prior art and in this invention the volume and the pole piece design with respect to the permanent magnets should be such where the pole pieces never reach saturation. When designed accordingly as to the saturation, the respective geometry in side-by-side interfacing adjacent areas and spacing then comes into its major effect. Please note the cross-sectional view of the pole pieces 52 and 54 in FIG. 8 that illustrates the reduced side-by-side cross-sectional areas.

The net result is that by reducing the mutual and self inductance between pole pieces 52 and 54 of hammers 16 and the neighboring pole pieces and hammers; the hammers can be released up to thirty six (36%) faster. Further to this extent, the retraction forces are increased so that operational cycle times of the movement of hammers 16 of the hammerbank can be improved upwards to fifteen percent (15%). Of course with less required time for release the total energy to overcome the permanent magnetism necessary for driving the coils 62 and 64 results in less power. It has been found that upwards of twelve percent (12%) less power is required.

Looking more specifically at FIGS. 5 and 6 it is seen that the retention magnet has been split in part into two elongated magnets namely magnets 96 and 98. Magnets 96 and 98 both respectively incorporate a magnetic circuit of south (S) to north (N) and again north (N) to south (S) so that magnetic flow can pass between them by means of a magnetic circuit connector or keeper 100. For optimum performance, the magnets should not drive the pole pieces 52 and 54 into saturation.

The split magnets 96 and 98 allow for the two respective magnets to be placed against the distal rearward ends of the pole pieces 52 and 54. The pole pieces 52 and 54 have removed flattened surfaces forming the distal ends that allow placement of the split magnets 96 and 98 thereagainst to provide in turn for a magnetic circuit through the pole pieces 52 and 54. This is also due to the magnetic circuit connector or keeper 100 that allows for the flow from magnet 96 to go south (S) north (N) and to the flow of the respective south (S) north (N) relationship of the second magnet 98.

The leads and terminals 70 and 72 are utilized to allow for conduction of driving voltage to the respective coils 62 and 64 around pole pieces 52 and 54.

The hammerbank fret 18 terminates in the upward projecting hammers 16. The hammers 16 have the attendant enlarged portions 26 and necked down intermediate portions 30 serving a dominant spring function with the pins 28 having the striking portions or tips 40.

The foregoing configuration as to the pole pieces 52 and 54, magnets 96 and 98, and magnetic circuit connector or keeper 100 are potted. The potting material surrounds the magnets 96 and 98 with the terminal portions of the pole pieces 44 and 46 extending therefrom.

Figure 2:
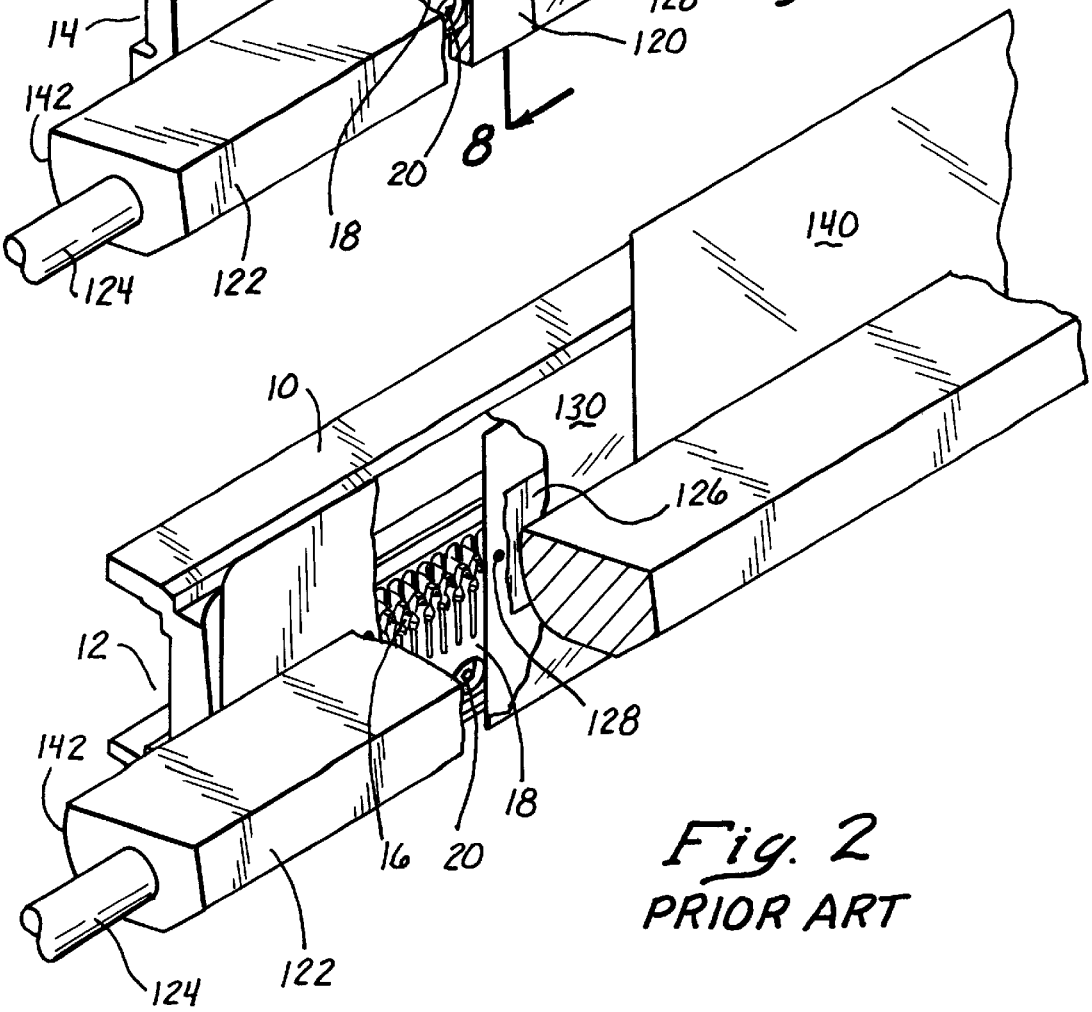
Fig. 2 PRIOR ART
FIG. 2 shows a fragmented perspective view of a prior art cover and hammerbank analogous to FIG. 1.
Figure 3:
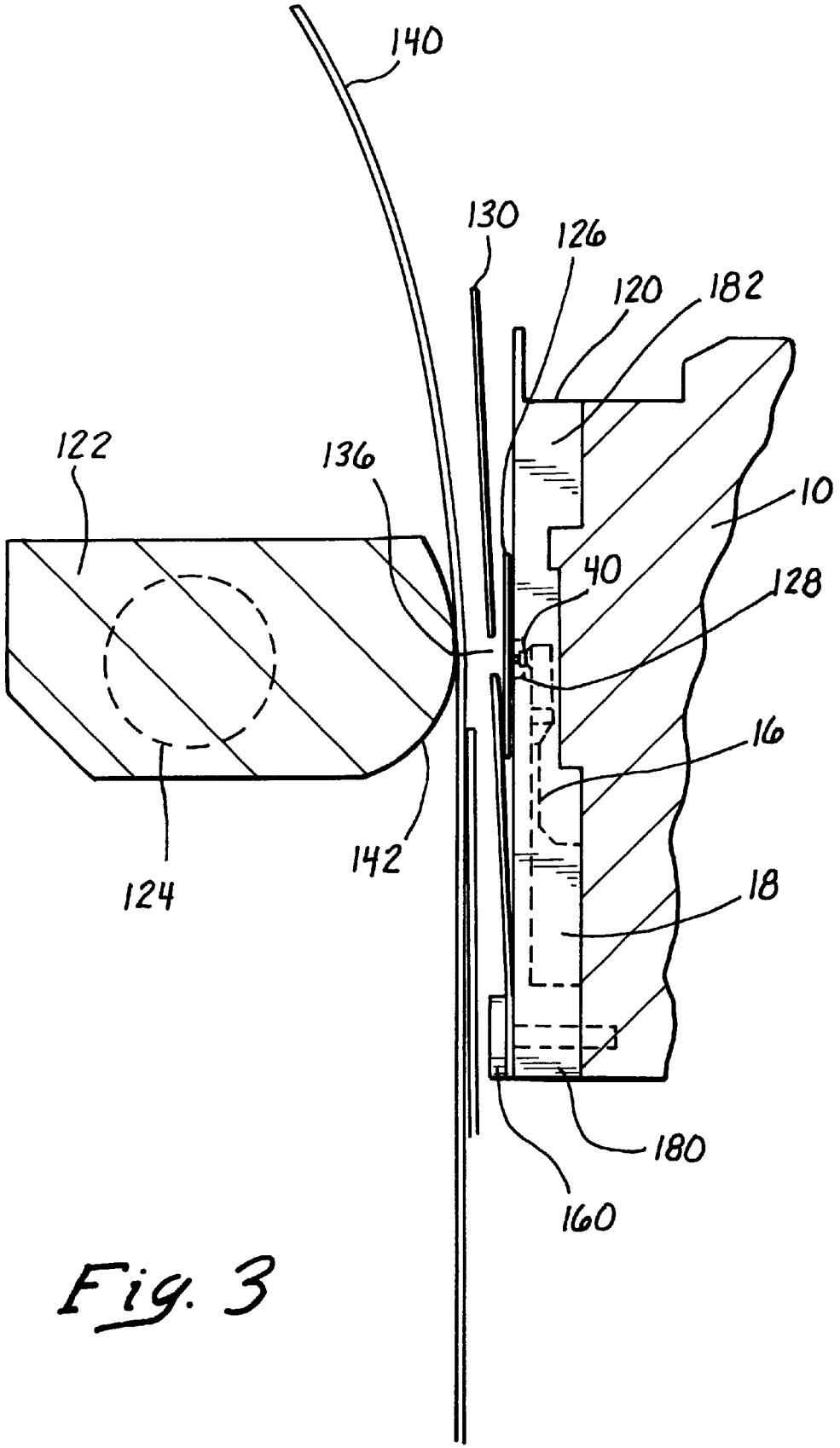
FIG. 3 shows a sectional view of the hammerbank, cover and associated hammerbank portions along lines 3—3 of FIG. 1.
Figure 8:
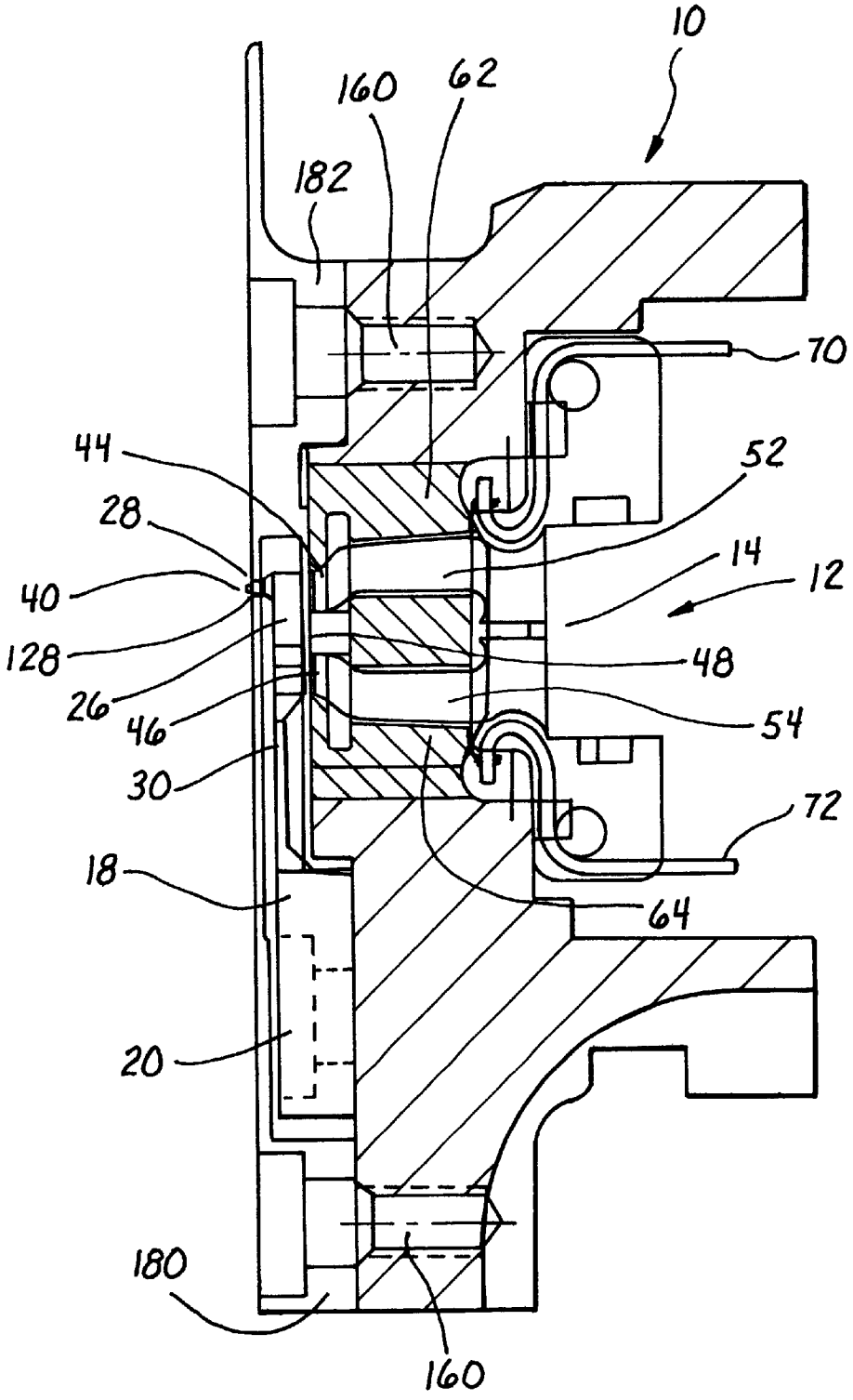
FIG. 8 shows a detailed sectional view of the hammerbank and cover as slightly modified of this invention along lines 8—8 of FIG. 1.

Looking more specifically at FIGS. 1 and 3, it can be seen that the operational aspects of the line printer are shown with paper or other media 140 passing therethrough. The hammerbank 10 has been fragmented to show the attachment of the cover thereon. The details of the operational components when printing as seen in FIGS. 1 and 3 are generally in the form of the hammerbank 10 with the cover 120 of this invention. The fret 18 and the attendant hammer 16 has been shown in FIG. 3 in a dotted configuration along with the tip extending therefrom. In FIG. 8, the details are more pronounced in the cross-section. The printer includes a platen 122 with a platen adjustment extension 124 which provides for the rotation of the platen in and out of the operating position. This is also utilized in the prior art as can be seen in FIG. 2.

Looking more particularly beyond the cover 120 and the respective hammers 16 that are therebehind, it can be seen that a ribbon 126 is shown. The ribbon 126 is the one impacted by the tips 40 of the hammers 16. They extend through the openings generally seen in dotted configuration within the cover namely openings 128. These openings are also apparent in the prior art of FIG. 2, and can be seen generally in the perspective view shown in FIG. 7.

Between the ribbon 126 and the paper or media to be printed on is a ribbon mask or a print mask 130. This ribbon mask 130 is such wherein it provides for masking of the print as ribbon 126. This helps to eliminate print ribbon smear and ink being spread in an unwanted manner as the hammer tips 40 pass through the openings 136 of the mask 130. The paper or media 140 passes over the platen face 142 of the platen 122. This allows the hammers 16 when released to be impacted against the ribbon 126 and attendantly cause printing on the underlying media or paper 140.

Figure 7:
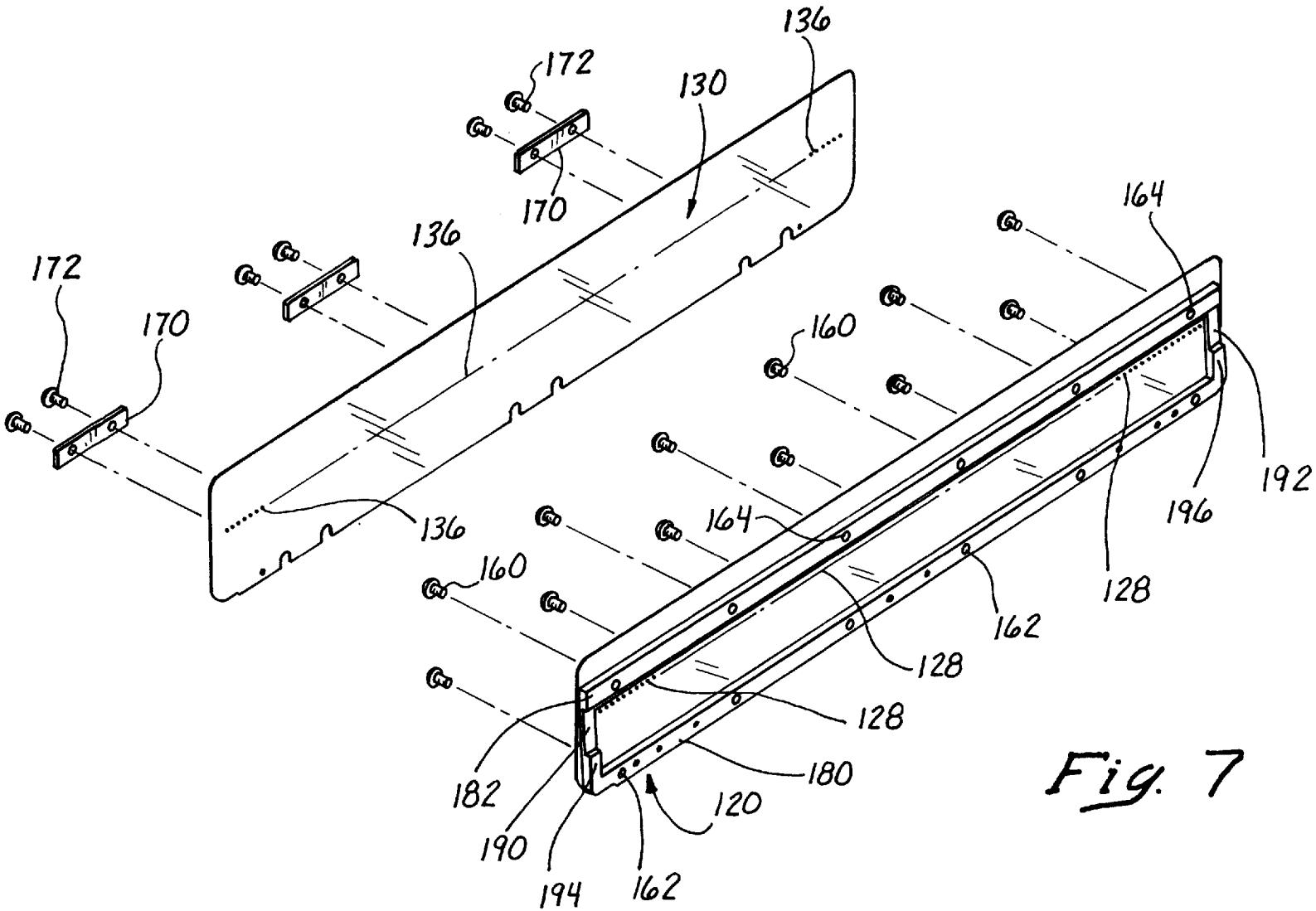
FIG. 7 shows a perspective exploded view of the hammerbank cover and the associated mask of this invention.

Looking more specifically at FIG. 7, it can be seen that the cover 120 of this invention is shown. The cover 120 specifically is secured to the hammerbank by screws or bolts 160 through openings such as openings 162 and 164 respectively in the lower and upper portions of the cover 120. This effectively allows the cover 120 to be screwed to the hammerbank in screw openings that are provided in the hammerbank portion.

The cover 120 incorporates the hammer tip openings 128 as can be seen in a plural line of openings along the length thereof. This allows for the tips 40 of the hammers to extend therefrom and provide an impact upon the paper or underlying media 140 on the opposite side of the mask 130.

The mask 130 is attached to the cover 120 by means of brackets or plates 170 and screws 172. The screws 172 are seated into the cover 120 and secured thereto. In this manner, the mask 130 can be removed and replaced in an easy and facile manner from the cover. Further to this extent, the mask 130 with its openings 136 does not shift appreciably as in the prior art. This enhances the overall function so that the mask does not need to be disassembled with the entire cover but can be bolted and held in place by the screws 172 and the brackets or plates 170.

The cover 120 has an enlarged cross-section or pedestal 180 and 182 along the length thereof. This adds rigidity and strength to the cover while at the same time when bolted to the hammerbank 10 provides for increased rigidity and serves to strengthen the hammerbank. The net result is that with the hammerbank cover 120 being bolted to the hammerbank, the cover provides increased strength so that the bending moments both longitudinally and laterally are not as pronounced. Further to this extent, with the cover 120 being attached to the hammerbank with the upper and lower bolts or screws 160, it can be appreciated that torque along the hammerbank longitudinal and lateral sections is decreased because of the strengthening provided by the cover 120. Also, the cover 120 adds stiffness to the extent where vibrations are lessened so as not to influence the printing characteristics as adversely as in the prior art. The torque and bending moments that have now been reduced with the attendant overall strengthening of the hammerbank serves to provide greater accuracy in printing.

The elongated protrusion, ridge, flange or ledge 180 can be seen as being a stiffening member as well as being a pedestal that is machined into the cover 120. This provides a resting place for the hammersprings 16 of the frets 18 upon the hammerbank precision machined surface. The net result is a more accurate alignment and tip 40 protrusion. Thus, the enlarged longitudinal flange, ledge or pedestal 180 provides for strengthening as well as a finer seating of the respective hammerbank frets 18.

The respective enlarged longitudinal cross-sectional areas of the flanges, ledges or ridges 180 and 182 can be substituted by other elongated formations. It should be noted that the cover 120 has a diminished lateral portion in the way of a space 190 and 192 at either end. These spaces 190 and 192 allow for placement in a more discrete manner. However, it should also be noted that the pedestal, ledge or enlarged portion 180 specifically has upright portions 194 and 196. These serve to further enhance the seating of the cover against the hammerbank.

From the foregoing, it can be seen that this invention is a significant step over the prior art insofar as line printers are concerned and the aspects of effecting stiffening, less deflection, improved bending moments, torque around the longitudinal and lateral axes, and the resulting printing.

What is claimed is:

1. A cover for a reciprocating hammerbank having a plurality of print hammers with printing tips for printing on a media with an inked ribbon comprising:

a single elongated metallic sheet mounted to the hammerbank along its length having upper and lower spaced apart elongated thickened sections; and, a plurality of openings in said elongated metallic sheet for receiving the print hammer tips therethrough.

2. The cover as claimed in claim 1 further comprising:

threaded securement members to attach the cover to said hammerbank; and, wherein said cover is machined from a piece of metal.

3. The cover as claimed in claim 1 further comprising:

a ribbon mask secured to said cover with threaded securement members.

4. The cover as claimed in claim 1 wherein:

at least one of said elongated thickened sections forms a pedestal substantially along the length of said cover.

5. The cover as claimed in claim 4 wherein:

said upper and lower spaced apart elongated thickened sections form two pedestals spaced apart from each other and extend substantially along the length of said cover; and, wherein said pedestals are machined into said cover from a single piece of metal.

6. A line printer having a hammerbank for printing on media with print hammers to impact a ribbon to form a dot matrix array comprising:

a plurality of hammers mounted on said hammerbank with printing tips;

a permanent magnet for retaining said hammers;

coil means for releasing said hammers;

a platen against which said hammer printing tips can strike a ribbon and underlying media between said platen and hammers; and, a single cover overlying said hammers having at least two ridges substantially along its length and secured to said hammerbank by threaded members.

7. The line printer as claimed in claim 6 further comprising:

a print ribbon mask threadably secured to said cover.

8. The line printer as claimed in claim 6 further comprising;

a print ribbon mask secured to said cover which can be removed integrally with said cover from said hammerbank.

9. A line printer hammerbank comprising:

a plurality of print hammers having printing tips mounted on said hammerbank;

permanent magnets for retaining said hammers against said hammerbank;

coils for overcoming the permanent magnetism provided by said permanent magnets for releasing said hammers; and, a cover for mounting over said hammers on said hammerbank with two enlarged substantially continuous cross-sectional areas extending substantially along the length thereof.

10. The line printer hammerbank as claimed in claim 9 further comprising:

a ribbon mask overlying said cover both of which having openings indexed to each other for receiving said printing tips therethrough.

11. The line printer hammerbank as claimed in claim 10 wherein:

said ribbon mask is threadably connected to said cover.

12. The line printer hammerbank as claimed in claim 9 wherein:

each enlarged cross-sectional area forms a mounting pedestal.

13. The line printer hammerbank as claimed in claim 9 wherein:

said magnets are split along the length of said hammerbank.

14. The line printer hammerbank as claimed in claim 13 wherein:

said magnets are retained by a magnetically conductive keeper.

* * * * *